United States Patent [19]

Lesick

[11] 4,195,369

[45] Apr. 1, 1980

[54] PORTABLE BIDET ATTACHMENT

[76] Inventor: Alvin B. Lesick, 2411 Deloraine Trail, Maitland, Fla. 32751

[21] Appl. No.: 932,479

[22] Filed: Aug. 10, 1978

Related U.S. Application Data

[63] Continuation of Ser. No. 780,293, Mar. 23, 1977, abandoned.

[51] Int. Cl.[2] ..... A47K 3/22; B05B 15/06

[52] U.S. Cl. ..... 4/7; 239/283; 248/226.1

[58] Field of Search ..... 4/1, 6, 7; 239/283, 239/282, 588; 269/321.5; 248/226.1, 284

[56] References Cited

U.S. PATENT DOCUMENTS

| | | | |
|---|---|---|---|
| 921,962 | 5/1909 | Don Jion | 4/6 |
| 1,411,572 | 4/1922 | Kramer | 248/226.1 |
| 1,876,478 | 9/1932 | Duzer | 248/226.1 X |
| 1,966,951 | 7/1934 | Guidettc | 4/7 |
| 2,291,870 | 8/1942 | Blair et al. | 248/226.1 |
| 2,344,561 | 3/1944 | Popil | 4/7 |
| 2,531,563 | 11/1950 | Feldheim | 248/226.1 |
| 2,605,136 | 7/1952 | Kline et al. | 239/282 |
| 3,045,248 | 7/1962 | Gentry | 4/7 |
| 3,164,846 | 1/1965 | Foster | 4/7 |
| 3,256,531 | 6/1966 | Arensberg | 4/7 |
| 3,357,663 | 12/1967 | Ivy | 248/284 X |
| 3,462,766 | 8/1969 | Merkel, Jr. | 4/7 |
| 3,602,921 | 9/1971 | Umann | 4/7 |
| 3,605,124 | 9/1971 | Marcard et al. | 4/7 |
| 3,654,636 | 4/1972 | Restyanzki | 4/7 |
| 3,808,608 | 5/1974 | Caplan | 4/7 |
| 4,028,745 | 6/1977 | Canigtia | 4/7 |

*Primary Examiner*—Stuart S. Levy
*Attorney, Agent, or Firm*—Russell D. Weaver; Murray Robinson; Ned L. Conly

[57] ABSTRACT

A bidet attachment including a clamp and a nozzle assembly, designed for quick attachment to any conventional toilet. The clamp includes an upper portion that clamps against the upper surface of the rim of the toilet and a lower portion that clamps against the lower surface of the rim while adjustably engaging the upper portion. The nozzle assembly includes a nozzle body having an inlet port, an outlet port and a fluid passageway interconnecting the ports. The nozzle assembly is attached to the upper portion such that when the bidet is in position on a toilet rim, the outlet port is aimed upwardly and toward the center of the toilet bowl.

15 Claims, 6 Drawing Figures

PORTABLE BIDET ATTACHMENT

This is a continuation of application Ser. No. 780,293, filed on Mar. 23, 1977; now abandoned.

BACKGROUND OF THE INVENTION

1. Field of the Invention

This invention relates generally to hygienic fixtures and particularly to devices for attachment to toilet bowls for cleansing and irrigating the external genital and posterior areas of the user's body.

2. Description of the Prior Art

Bidets have been developed in a number of forms for the purpose of cleansing the genital and posterior areas of the body. In general, bidets of the prior art have comprised a nozzle connected to a fluid source with the nozzle mounted over a catch basin. By sitting or squatting over the nozzle, a user can cleanse his or her genital or posterior region. Excess liquid is caught in the catch basin so that it can be appropriately disposed.

Although conventional bidets are independent fixtures in the nature of a toilet, numerous devices have been developed so that the conventional toilet can be adapted for use as a bidet. See U.S. Pat. Nos. 3,654,636 issued to Restyanski on Apr. 11, 1972; 3,605,124 issued to Marcard, et al., on Sept. 18, 1969; 3,256,531 issued to Arensberg on June 21, 1966; 3,164,846 issued to Foster on Jan. 12, 1965; 3,045,248 issued to Gentry on July 24, 1962; 1,966,951 issued to Guidetti on July 17, 1934; and 921,962 issued to Don Jian on May 18, 1909. One of the goals of such devices is to provide the function of the conventional bidet without the expense of a separate permanent fixture and without consuming extra floor space in a bathroom. To differing extents, each of the above listed devices appears to meet such a goal.

It is also desirable that such devices be portable and universal. Optimum portability includes the ability to quickly attach and detach the device to and from the toilet so that the device need not remain attached to the toilet when the device will not be used for an extended period of time. Optimum portability also includes the ability to carry the device from one place to another. Thus, a user suffering from a nuisance problem that can last over an extended period of time, such as hemorrhoids, can carry the device along on business trips and vacations. The device, therefore, should be light in weight and compact in size so that it can be carried discretely in a suitcase or the like without being damaged.

For optimum universality, the device must be immediately attachable to essentially any toilet so that the toilet need not be modified in order to accommodate the device. Otherwise, the device could not be attached to a toilet in a hotel or the like during a business trip or vacation.

Additionally, the device should be adjustable so that the shower bath can be concentrated on the area of the body that is to be cleansed or treated.

Because treatment may be continued over a period of days or even longer, it is sometimes desirable that the device remain attached over a long period of time. Thus, the toilet should be usable for normal toilet functions while the device is attached.

Although each of the devices of the prior art has, to some extent, one or more of these desirable features, no device of the prior art incorporates all such features. For instance, the embodiments of FIGS. 3 through 8 of Arensberg can be attached to the toilet only by either first disassembling the toilet or modifying the toilet. Furthermore, once these embodiments are installed, they cannot be adjusted to fit the needs of the particular user. The remaining embodiment of Arensberg (FIG. 1 of Arensberg) also is not adjustable. Additionally, that embodiment's long tubular shape hampers its portability; it could be bent easily if packed in a suitcase. Because the Arensberg embodiments rely on a resilient C-clamp for attachment, they may not be attachable to all toilets since the thickness of the rim of the bowl may vary.

The Foster device must be removed from the toilet if the toilet is to be used for normal toilet function. Furthermore, the Foster device sprays vertically upward causing the fluid to fall back onto the nozzle after striking the user's body. Such a feature necessitates constant cleansing of the device and may cause the device to become contaminated during use.

The Restyanski and Don Jian devices each include an independent catch basin that is very large and must be removed and cleaned after each use. The Restyanski device is not adjustable. The nozzle disclosed by Don Jian is hand held and, although adjustable, is very inconvenient.

The Marcard, Gentry, and Guidetti devices all require modification and/or disassembly of the toilet in order to be attached. The Marcard and Gentry devices are too large to be easily moved from one location to another. The Guidetti device requires substantial modification of the toilet and, therefore, is not even movable.

SUMMARY OF THE INVENTION

The present invention is a device for performing the function of a bidet. The device can be quickly attached to any conventional toilet, can be carried easily by a user from one location to another, can be adjusted according to a particular user's needs, and can remain in place while the toilet is used for ordinary toilet functions. The device is inexpensive, attractive, and capable of being easily cleaned.

The present invention includes an upper clamp for engaging the upper surface of a toilet rim and a lower clamp for engaging the lower surface of the toilet rim. The bodies of the clamps adjustably engage one another. Locking devices are included for selectively fixing the position of the clamping surface of one clamp relative to the clamping surface of the other clamp. The invention further includes a nozzle assembly having a nozzle body with an inlet port, an outlet port, and a fluid passageway inter-connecting the ports. The nozzle assembly is connected to the upper clamp body such that the outlet port faces generally away from the bodies of the upper clamp and lower clamp.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 2:
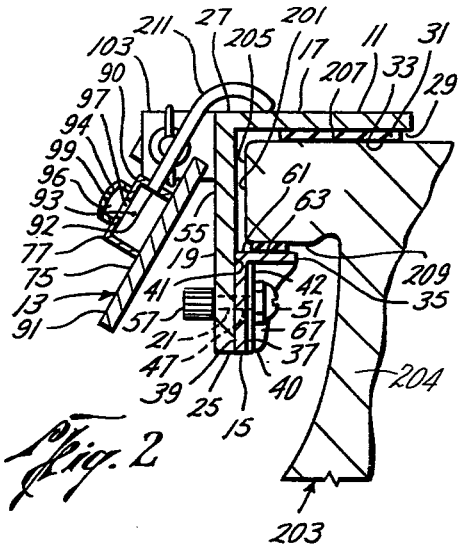
FIG. 2 is sectional view of the apparatus of FIG. 1 taken along line 2—2.
Figure 3:
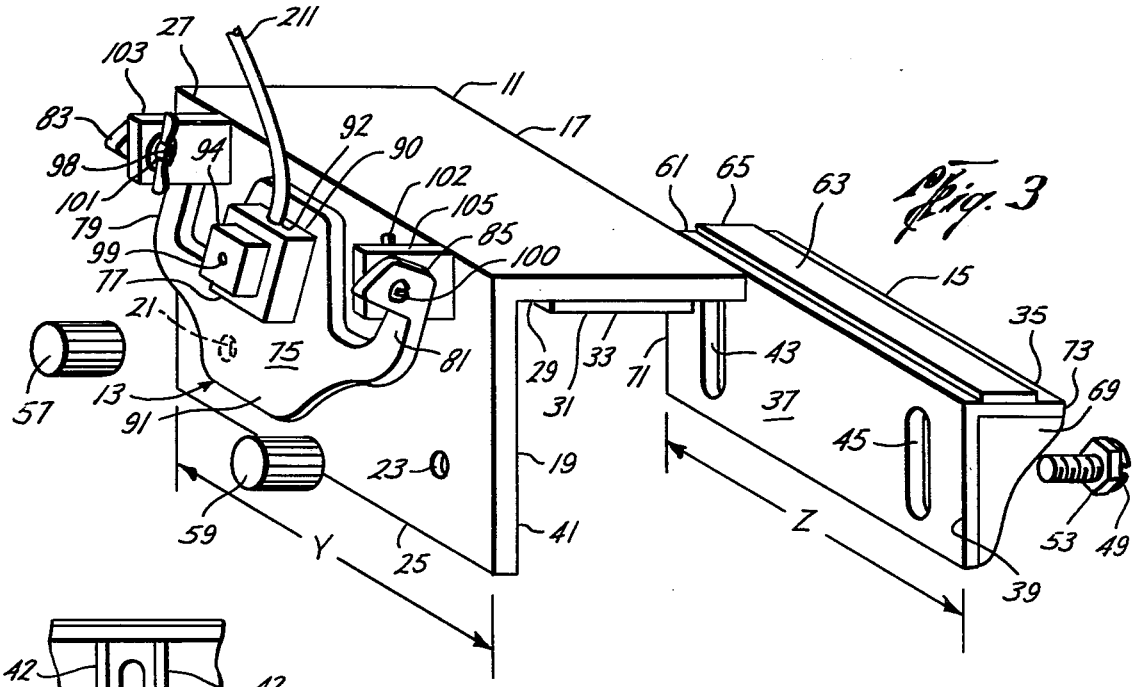
FIG. 3 is a partially exploded isometric view of the preferred embodiment of the apparatus of the invention.

As shown in FIGS. 2 and 3, the preferred embodiment of the apparatus of the invention comprises an upper clamp member 11 having a nozzle assembly 13 attached to it, and a lower clamp member 15.

Upper clamp member 11 includes front face plate 19 and upper clamping portion 17 which are connected together to form a right-angle bracket having a width Y of 4½ inches. Front face plate 19 includes top edge 27 and bottom edge 25. Front face plate 19 has apertures 21, 23 through it. Aperture 21 is located near one side of front face plate 19, and aperture 23 is located near the other side of front face plate 19. Apertures 21, 23 further are located closer to bottom edge 25 than they are to top edge 27. Upper clamping portion 17 includes lower clamping surface 29. Attached to surface 29 is strip 31 having non-slip surface 33.

Lower clamp member 15 includes lower clamping portion 35 and rear face plate 37 which are connected together to form a right-angle bracket having a width of Z of 4½ inches. Lower clamping portion 35 includes upper clamping surface 61. Strip 63 having non-slip surface 65 is attached to surface 61. Reinforcement webs 67, 69 extend between lower clamping portion 35 and rear face plate 37 at side edges 71, 73, respectively.

Figure 4:
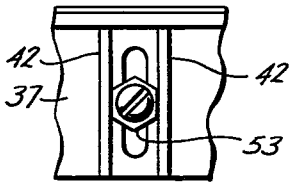
FIG. 4 is a partial view of the preferred embodiment of the apparatus of the invention.

Outer surface 39 of rear face plate 37 juxtaposes surface 41 of front face plate 19. Rear face plate 37 has slots 43, 45 which align with apertures 21, 23, respectively. Along each side of slots 43, 45 and on surface 40 of rear face plate 37 is a ridge 42. (See FIG. 4). Screws 47, 49 having hexagonal heads 51, 53 extend through slots 43, 45, and apertures 21, 23, respectively, such that heads 51, 53 rest against surface 40 of rear face plate 37 and between ridges 42. Screws 47, 49 are secured in place by thumb nuts 57, 59, respectively.

Nozzle assembly 13 includes yoke 75 and nozzle 77. Yoke 75 has support surface 91 and arms 79, 81 extending from support surface 91 substantially parallel to one another. Arms 79, 81 have enlarged ends or knobs 83, 85, respectively. Knobs 83, 85 each have a radial knob hole therein.

Nozzle 77 is attached to yoke 75 at support surface 91 of yoke 75. Nozzle 77 includes base portion 90 having chamber 93 and port 92. Nozzle 77 further includes tip portion 94 attached to bare portion 90 and having chamber 96 and outlet 99. Chamber 93 of base portion 90 communicates with tip chamber 96 by means of passageway 97.

Nozzle assembly 13 is secured to front face plate 19 by means of support bars 103, 105 which extend from outer surface 55 of front face plate 19. Bars 103, 105 each have a radial bar hole therethrough. The distance from the outside of bar 103 to the outside of bar 105 is equal to the spread of arms 79, 81. The knob holes are aligned with the bar holes. Screw 98 extends through the hole in bar 103 and arm 79 and is secured in position by wing nut 101. Screw 100 extends through the holes in bar 105 and arm 81 and is secured in position by wing nut 102.

In the preferred embodiment, the entire apparatus is made of molded plastic. Upper clamp member 11, including bars 103, 105, as well as lower clamp member 15, yoke 75, and nozzle 77 are each molded separately. Nozzle 77 is attached to yoke 75 by glueing. Nozzle assembly 13 is then movably secured to upper clamp member 11 by sliding arms 79, 81 over bars 103, 105, respectively. Nozzle assembly 13 is adustably secured to bars 103, 105 by means of screws 98, 100 and nuts 101, 102. Strips 31 and 63 are then secured to lower clamping surface 29 and upper clamping surface 61 respectively. Upper clamp member 11 and lower clamp member 15 are loosely secured together with screws 47, 49 and nuts 57, 59.

Figure 1:
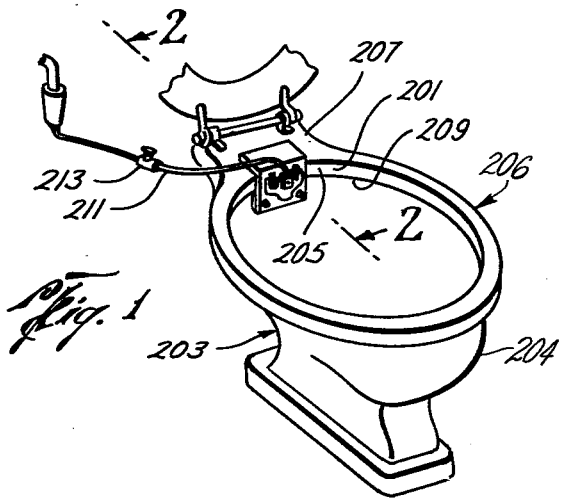
FIG. 1 is a pictorial view of the preferred embodiment of the apparatus of the invention attached to a toilet.

In this state, the apparatus can be readily attached to almost any toilet. Referring to FIGS. 1 and 2, toilet 203 includes bowl 204 having a mouth whose upper edge is defined by rim 206. Rim 206 includes outer rim edge 205 facing toward the center of the mouth of the bowl, upper rim edge 207 facing upwardly and lower rim edge 209 facing downwardly. When attaching the apparatus to toilet 203, screws 47, 49 are tightened so that there is little play along the axis of screws 47, 49. Sufficient play is allowed, however, to permit lower clamp 15 to move perpendicular to the screw axis with respect to upper clamp member 11. Upper clamping portion 17 and lower clamping portion 35 are spread apart until the clamping surfaces fit over rim 201 of toilet 203 and outer rim edge 205 abuts surface 41 of front face plate 19. Clamping portions 17, 35 are then drawn together until strips 31, 63 clamp against upper rim edge 207 and lower rim edge 209, respectively. When the apparatus is positioned on rim 206 as just described, thumb nuts 57, 59 extend from front face plate 19 generally toward the center of the bowl. Screws 47, 49 are then fully tightened. By using thumb nuts, no tools are necessary.

With the apparatus in position as described, flexible plastic tube 211 is force fitted into port 92. The other end of tube 211 is connected to a source of fluid supply, such as a water basin faucet, through valve 213. Valve 213 should be within easy reach of the toilet. Tube 211 should run beneath the toilet seat.

By turning the fluid supply source on and opening valve 213, fluid is forced into chambers 93, 96 and out through outlet 99 thus creating a spray directed away from nozzle 77. By rotating yoke 75 about bars 103, 105, the user can adjust the actual direction of spray. By tightening wing nuts 101, 102, yoke 75 is retained in the adjusted position. When not in use, yoke 75 can be forced against front face plate 19 making the apparatus virtually unnoticeable.

Further adjustment of the device may be effected by positioning the apparatus at different points on the toilet rim. Thus, the apparatus can be positioned at the rear of the toilet as shown in FIG. 1 for cleansing the posterior areas of the user's body and at the front of the toilet for cleansing the genital area of the user's body.

Although the apparatus described in detail supra has been found to be most satisfactory and preferred, many variations in structure are possible.

Figure 5:
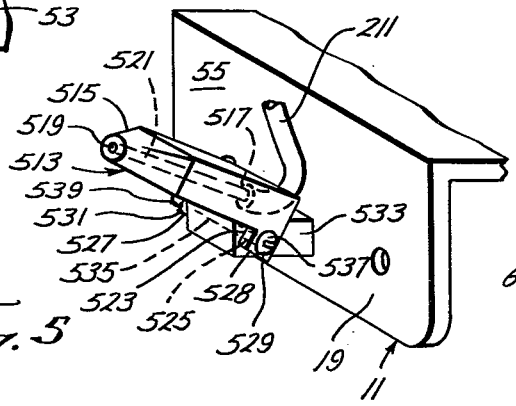
FIG. 5 is a partial view of a first alternative embodiment of the apparatus of the invention.
Figure 6:
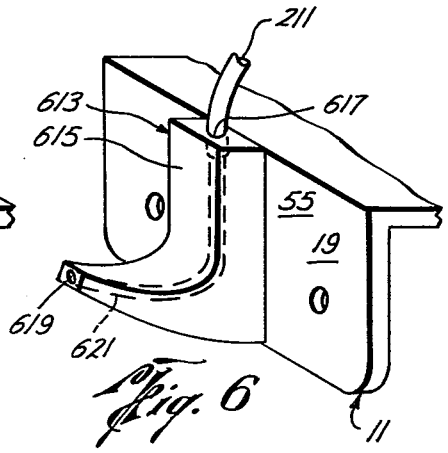
FIG. 6 is a partial view of a second alternative embodiment of the apparatus of the invention.

For example, in the alternative embodiments shown in FIGS. 5 and 6, upper clamp 11 and lower clamp 15 are unchanged. In the first alternative embodiment of FIG. 5, nozzle assembly 513 comprises elongate nozzle body 515 having inlet port 517 near one end, outlet port 519 at the tip of the other end and fluid passageway 521 therethrough connecting the ports. Nozzle body 515 has notch 523 at the end near inlet port 517. Nozzle arms 525, 527, having arm holes 529, 531, respectively, extend from nozzle body 515 on either side of notch 523. Nozzle assembly 513 further includes bar 533 which extends from the lower center of surface 55 of front face plate 19. Bar 533 has bar hole 535 therethrough. Nozzle body 515 is positioned such that notch 523 is disposed over bar 533 with arm holes 529, 531 aligned with bar hole 535 and with outlet port 519 opening away from front face plate 19. Screw 537 extends through arm holes 529, 531 and bar hole 535. It is secured therein by locking nut 539.

The embodiment of FIG. 5 is operated similarly to the embodiment of FIGS. 1–4. Tube 211 is friction fitted into inlet port 517. Cleansing fluid flowing through tube exits through outlet port 519 in a spray. The direction of spray is adjusted by rotating nozzle body 215 about screw 537. By tightening screw 537, the position of nozzle body 215 can be fixed after rotation.

In the second alternate embodiment of FIG. 6, nozzle assembly 613 comprises J-shaped nozzle body 615 which is rigidly connected to surface 55 of front face plate 19. Nozzle body 615 has inlet port 617 at its uppermost part and outlet port 619 at its other tip. Fluid passage 621 within nozzle body 615 interconnects ports 617 and 619.

Operation of the embodiment of FIG. 6 includes friction fitting tube 211 into inlet port 617 and applying fluid pressure. The fluid exits through outlet port 619 in the direction of the user. Direction of the spray can be adjusted by moving the apparatus to different locations on the toilet rim.

The above alternative embodiments are exemplary of the possible changes or variations.

Because many varying and different embodiments may be made within the scope of the inventive concept herein taught and because many modifications may be made in the embodiment herein detailed in accordance with the descriptive requirements of the law, it should be understood that the details herein are to be interpreted as illustrative and not in a limiting sense.

What is claimed as invention is:

1. A bidet attachment for use with a toilet having a bowl with a rim defining the upper edge of the mouth of the bowl, the rim including an upper horizontal surface, a lower horizontal surface, the lower horizontal surface being disposed generally directly beneath said upper horizontal surface, and a vertical surface extending between the upper and lower horizontal surfaces and facing generally toward the center of the mouth of the bowl, the attachment comprising:

a first clamp member having first clamping means for engaging a portion of the upper horizontal surface and a first face plate attached to said first clamping means, said first face plate having a planar outer surface and an opposite planar inner surface and extending downwardly from said first clamping means such that said outer surface faces generally toward the center of the mouth of the bowl and the lowermost portion of said first face plate extends below the lower horizontal surface when said first clamping means engages said upper horizontal surface;

a second clamp member having second clamping means for engaging a portion of the lower horizontal surface and a second face plate attached to said second clamping means, said second face plate having a planar outer surface and extending downwardly from said second clamping means such that said planar outer surface of said second face plate juxtaposes the lowermost portion of said inner face of said first face plate when said second clamping means engages said lower horizontal surface;

connecting means for adjustably connecting said first clamp member to said second clamp member to form a clamp, said connecting means extending between said second face plate and the lowermost portion of said first face plate and extending outwardly from said outer surface of said first face plate generally toward the center of the mouth of the bowl;

a nozzle assembly having an inlet port, an outlet port, and a passageway interconnecting said inlet port and said outlet port; and attachment means for attaching said nozzle assembly to said first face plate outer surface wherein said nozzle assembly is located at the level of or below the upper horizontal surface of said first clamping means and extends outwardly from said outer surface of said first face plate generally toward the center of the mouth of the bowl, with said outlet port of said nozzle assembly being directed generally away from said outer surface of said first face plate.

2. A bidet attachment as recited in claim 1 wherein said attachment means fixes said nozzle assembly relative to said first clamp member.

3. A bidet attachment as recited in claim 2 wherein said nozzle assembly includes a rigid tubular body formed in the general shape of a J, said inlet port being near the upper end of said body and said outlet port being at the lower tip of said body, and said passageway extending through said body.

4. A bidet attachment as recited in claim 1 wherein said attachment means includes adjustment means for adjustably fixing the position of said nozzle assembly relative to said first clamp member.

5. A bidet attachment as recited in claim 4 wherein said nozzle assembly includes a body, said inlet port being located in one surface of said body, said outlet port being located in another surface of said body, and said passageway extends through said body.

6. A bidet attachment as recited in claim 5 wherein said attachment means includes a bar on said first face plate, said body being mounted on said bar such that said outlet port opens away from said first face plate.

7. A bidet attachment as recited in claim 5 wherein said nozzle assembly further includes a yoke having two arms connected at a center portion, said body being attached to said center portion.

8. A bidet attachment as recited in claim 7 wherein said attachment means includes two bars on said first face plate said arms being mounted on said bars.

9. A bidet attachment as recited in claim 1 wherein said connecting means includes a first hole through said first face plate and a substantially vertical elongate first slot through said second face plate, said first slot being aligned with said first hole; and a first screw and a first nut, said first screw extending through said first hole and said first slot and threaded onto said first nut.

10. A bidet attachment as recited in claim 9 wherein said connecting means further includes a second hole through said first face plate; and an elongate second slot through said second face plate; said second slot extending parallel to said first slot and aligned with said second hole; and a second screw and a second nut, said second screw extending through said second hole and second slot and threaded onto said second nut.

11. A bidet attachment as recited in claim 10 wherein said attachment means includes a bar attached to said first face plate and extending therefrom in a direction substantially opposite that of said first clamping portion and adjustment means for adjustably fixing the position of said nozzle assembly relative to said bar.

12. A bidet attachment as recited in claim 10 wherein said attachment means includes two bars attached to said first face plate and extending therefrom in a direction substantially opposite that of said first clamping portion, and said nozzle assembly includes a yoke having two arms connected by a center portion; said arms being attached to said bars such that said yoke can be rotated about said bars, said attachment means including adjustment means for adjustably fixing the position of said yoke relative to said bars.

13. A bidet attachment as recited in claim 12 wherein said nozzle assembly further includes a body, said inlet port being located in one surface of said body and said outlet port being located in another surface of said body, and said passageway extends through said body, said body being connected to said center portion.

14. A bidet attachment according to claim 1 wherein there is included;

a tube attached to said inlet port.

15. A bidet attachment according to claim 14 wherein there is further included;

a valve connected to said tube.

* * * * *